US007090142B2

(12) United States Patent
Rantzén

(10) Patent No.: US 7,090,142 B2
(45) Date of Patent: Aug. 15, 2006

(54) HOT AIR AGGREGATE

(76) Inventor: Lennart Rantzén, Södra Ringgatan 46, SE-441 33, Alingsås (SE)

( * ) Notice: Subject to any disclaimer, the term of this patent is extended or adjusted under 35 U.S.C. 154(b) by 0 days.

(21) Appl. No.: 10/518,355

(22) PCT Filed: Jun. 18, 2003

(86) PCT No.: PCT/SE03/01046

§ 371 (c)(1),
(2), (4) Date: Jun. 24, 2005

(87) PCT Pub. No.: WO03/106895

PCT Pub. Date: Dec. 24, 2003

(65) Prior Publication Data

US 2005/0258262 A1 Nov. 24, 2005

(30) Foreign Application Priority Data

Jun. 18, 2002 (SE) ..... 0201926

(51) Int. Cl.
*F23J 13/02* (2006.01)

(52) U.S. Cl. ..... 237/46; 237/70

(58) Field of Classification Search ..... 237/46, 237/50, 2 A, 70; 431/156, 203, 107
See application file for complete search history.

(56) References Cited

U.S. PATENT DOCUMENTS 5,048,753 A * 9/1991 Kellie ..... 237/12.3 C
5,121,739 A * 6/1992 Barker ..... 126/248
5,340,020 A * 8/1994 Maus et al. ..... 237/12.3 C
5,456,408 A * 10/1995 Appel ..... 237/2 A
6,209,795 B1 * 4/2001 Rose ..... 237/9 B
6,308,895 B1 * 10/2001 Atxa et al. ..... 237/2 A (Continued)

FOREIGN PATENT DOCUMENTS

DE 19715374 A 10/1997

(Continued)

*Primary Examiner*—Derek S. Boles
(74) *Attorney, Agent, or Firm*—Dickstein Shapiro LLP

(57) ABSTRACT

The invention relates to an arrangement in a hot air aggregate comprising a cover (2) having a built-in fan (3), an enclosed chamber (4) after said fan (3) which extends into a conically formed, front portion (5), to which a burner unit (7) having an enclosed burner (9) supplied with a gas flow and a nozzle (10) are provided via a connecting coupling sleeve (6). Said fan (3) is fixed via a sealing means (11) against an inner tube (12) insulated from said cover (2) and delimits the back portion (13) of the enclosed chamber (4) and its opposite front portion (14) extends into the conical portion (5), which comprises on its inner mantle surface (15) inclined wings to give the streaming air through the same an extra rotation before its passage into the burner (9), said chamber (4) comprises an air guard (16) for sensing the right air flow into the burner (9) at the same time as in front of or after said fan (3) there are within said cover (2) integrated an electronic controlling unit (17) and a magnetic valve (18) for adjusting of air- and gas flows, said burner unit (7) comprises an adjusting means (19) for ignition and starting of the fan (3) when the pressure has been increased sufficiently in the chamber (4) at the same time as a sensor gives a signal to said magnet valve (18) to open said gas supply for ignition of a gas flame enclosed in the burner, and said nozzle (10) is double mantled having the possibility of cooling by aid of cooling air in the gap space (20) of the double mantle (21).

4 Claims, 2 Drawing Sheets

Figure 1:
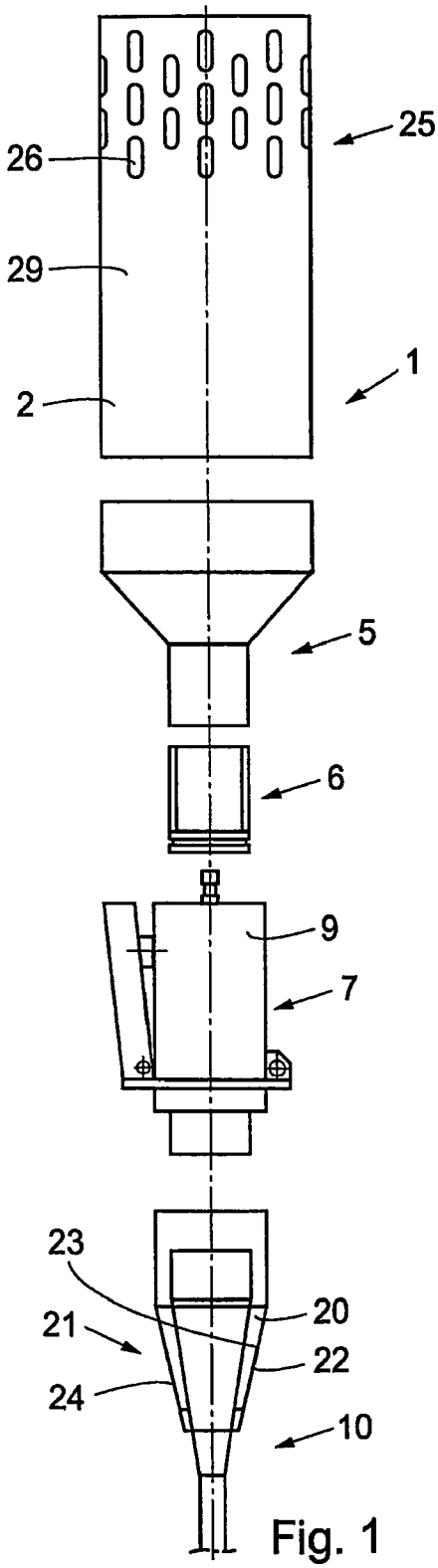

U.S. PATENT DOCUMENTS 6,431,124 B1 * 8/2002 Kwon ..... 122/13.3

FOREIGN PATENT DOCUMENTS

DE 19906389 A1 8/2000
EP 0690274 A1 1/1996
SE 461409 B 2/1990
SE 9201578 A 11/1993

* cited by examiner

HOT AIR AGGREGATE

The present invention refers to an improvement in a hot air aggregate comprising a cover having a fan built into the same, a closed chamber after the fan which extends into a conically formed, front portion, to which a burner is connected through a connecting sleeve, said burner is supplied with a gas flow and a nozzle. The hot air aggregate according to the invention is primarily intended to be used in a welding machine for applying a roof covering material.

Presently, different types of devices are used during the application of roof covering material and one example of such a device is a movable wagon having wheels and rollers, which is intended to join together two unrolled rolls of roof covering in connection to a joint. This is made in such a way that respective roof covering material in the joint area is heated by hot gas, which by aid of a nozzle is blown into the joint at the same time as the wagon is moved forward and by aid of its pressing roller presses together the covering layers lying on top of each other, said layers constitute the joint when the wagon is moved forwards, so that the melted material from the roof covering forms an adhesive. Usually these welding machines comprise a LPG-tube from which a gas is supplied through a strong supplying pipe up to a hot air burner situated in the end of the gas pipe, where there is a nozzle, through which the hot gas can be fed out. By placing the hot gas burner immediately before said nozzle a totally closed combustion occurs, so that only a mixture of nitrogen and carbon dioxide remains in the hot gas flowing out from said nozzle. This means that in the present case it is not the question about a totally open flame as in the normal case, i.e. from direct flowing of gas from for example a LPG-source which can result in that the warming up area starts to burn. One problem with this type of hot gas burner is that it is difficult to handle owing to its heavy, ungainly design, and complicated control functions for adjusting of the air- and gas flow. Further there is a large risk of burning at the nozzle in this design, which in use has a very high temperature.

The object of the present invention is to provide a new type of hot air aggregate which eliminates the problem mentioned above, and which has a design which is easy and simple to handle having integrated adjusting functions for air- and gas flow. The characterizing features of the invention are stated in the claims enclosed.

Thanks to the invention a hot air aggregate has been provided which in an excellent way fulfils its purposes at the same time as it also is cheap and easy to manufacture. The flexibility of the aggregate is attained by means of primarily the supplying pipes for gas and electricity to the motor and possible any hand burners and also sensors of different kind for adjusting of air- and gas flows are integrated in the design itself. The burner unit itself comprises according to the invention a press button for ignition and start of the fan, when the pressure has been increased enough, so that a pressure guard gives a signal to a magnetic valve, which opens the supply of gas, so that the aggregate is ignited. In the closed chamber, which is located after the fan, also an air guard is provided, which during insufficient gas flow automatically shuts off said burner. Furthermore, the nozzle has been provided with a double mantle for eliminating risks of burning.

Figure 2:
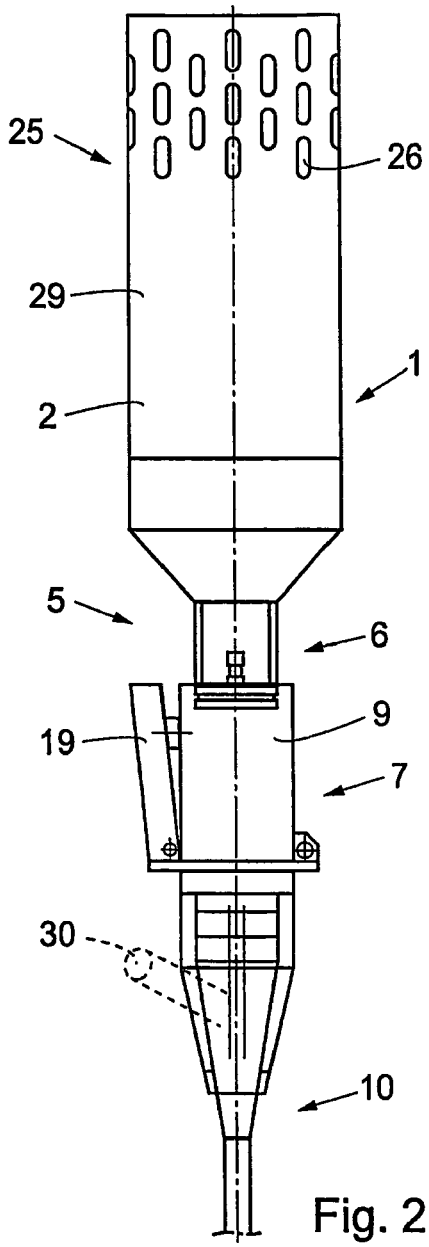
Figure 3:
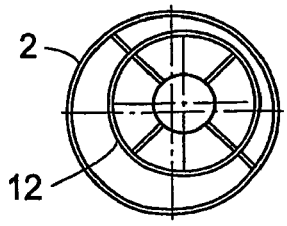
Figure 4:
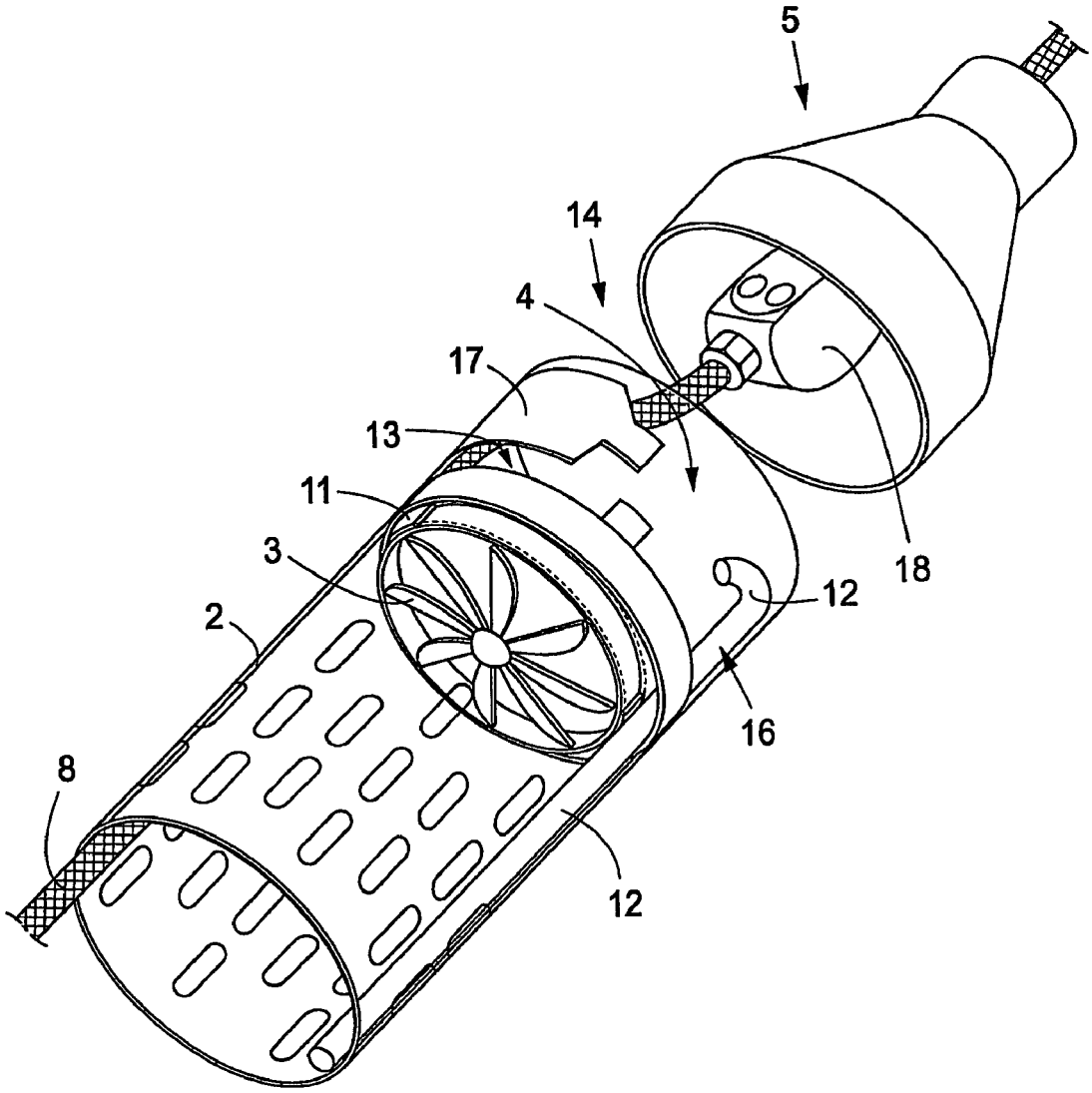
Figure 5:
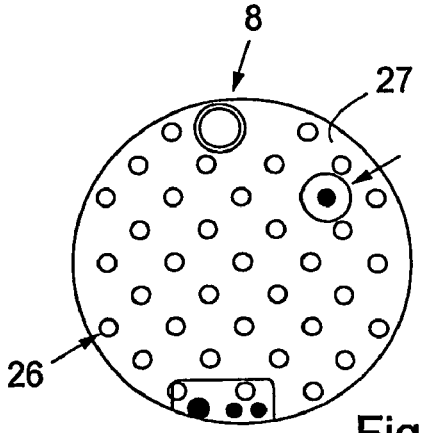

The invention is described in more detail below by means of a preferred embodiment example during reference to the drawings enclosed, in which, FIG. 1 shows a schematic side view of a hot air aggregate according to the invention, partly in exploded view, FIG. 2 shows a side view of the hot air aggregate illustrated in FIG. 1 in a mounted state, FIG. 3 is a schematic cross section through the burner, showing the outer cover having an inner tube provided in the same and insulated therefrom for constituting a place for the fan and also a closed chamber after the same, FIG. 4 is a schematic, partial, perspective view partly in section of the hot air aggregate illustrated in FIGS. 1 and 2, and FIG. 5 shows an example of a gable for the actual hot air aggregate.

As can be seen in more detail from the drawings a preferred example of a hot air aggregate 1 according to the invention is illustrated, which comprises a cover 2 having a built-in fan 3, a closed chamber 4 after the fan 3, which extends into a conically formed, front portion 5. In the front portion 5 a burner unit 7 and a nozzle 10 are provided in a connecting sleeve 6. An enclosed burner 9 is provided in the burner unit 7, said burner is supplied with a gas flow from a gas pipe 8.

In the embodiment illustrated the fan 3 is fixed via sealing means 11 against an inner tube 12 which is insulated from said cover 2 and at the same time delimits the back portion 13 of the closed chamber 4 while its opposite front portion 14 extends into the conical portion 5. The conical portion 5 is provided with wings on its inner mantle surface 15, not illustrated on the drawing, in order to give the flow air through the same an extra rotation before its passage into the burner 9. The chamber 4 has an air guard 16 in the form of a bent pipe 17 in order to determining the right flow of air to the burner 9 at the same time as upstreams or downstreams said fan 3 there are integrated inside said cover 2 an electronic adjusting unit 17 and a magnetic valve 18 for adjusting of air- and gas flows. The burner unit 7 comprises an adjusting means 19 by aid of which the starting of the fan 3 can take place and an ignition of a gas flame within said burner 9, if the pressure is increased enough in said chamber 4 at the same time as a sensor, not closer illustrated on the drawing, gives a signal to said magnetic wall 18 to open the gas supply for ignition of the gas flame in the burner. In the example illustrated the nozzle 10 is double mantled having a possibility of cooling by aid of cooling air in the gap space 20, which said double mantle 21 comprises.

The gap space 20 in said double mantling 21 of said nozzle 10 comprises an insulating material 22 preferably in the form of a ceramic layer on the inside 23 of the outer mantle 24. The back portion 25 of the hot air aggregate 1 comprises air intakes 26 in its back gable wall 27 and/or in the back area 28 of the sides 29 of the cover 2.

In the present case the nozzle 10 can be provided with a branch off means 30 for connecting of a traditional, electrically driven hot air gun for increasing of the effect of the outstreaming hot air.

The invention claimed is:

1. An arrangement for a hot air aggregate comprising a cover (2) having a built-in fan (3), a closed chamber (4) after said fan (3) which extends into a conically formed front portion (5) to which a burner unit (7) with an enclosed burner (9) supplied with a gas flow and a nozzle (10) are provided via a connection sleeve (6), characterized in that said fan (3) is fixed via sealing means (11) against an inner tube (12) insulated from said cover (2) and delimits in the longitudinal direction of the hot air aggregate (1) the back portion (13) of the enclosed chamber (4) and its opposite front portion (14) extends into the conical portion (5), showing on its inner mantle surface (15) inclined wings for giving the air supplied through the same an extra rotation before its passage into the burner (9), said chamber (4) comprises an air guard (16) for sensing the right air flow up to the burner (9) at the same time as in front of or after said fan (3) there are integrated within said cover (2) an electronic controlling unit (17) and a magnetic valve (18) for adjusting of air- and gas flows, said burner unit (7) comprises adjusting means (19) for ignition and starting of said fan (3) when the pressure has been increased sufficiently in the chamber (4) at the same time as a sensor gives a signal to the magnetic valve (18) to open the gas supply for ignition of a gas flame enclosed in the burner, and said nozzle (10), is double mantled having the possibility of cooling by aid of cooling air in the gap space (20) of the double mantle (21).

2. An arrangement according to claim 1, characterized in that the gap space (20) in the double mantle (21) of the nozzle (10) is provided with an insulating material (22) preferably in the form of a ceramic layer on the inside (23) of the outer mantling (24).

3. An arrangement according to claim 1, characterized in that the back portion (25) of the hot air aggregate (1) is provided with air intakes (26) in its back gable wall (27) and/or in the back area (28) of the sides (29) of the cover (2).

4. An arrangement according to claim 1, characterized in that said nozzle (10) comprises a branch off means (30) for connection to a traditional electrically driven hot gun for increasing the effect of the outcoming hot air.

* * * * *